United States Patent [19]

Yoshida

[11] Patent Number: 4,951,545

[45] Date of Patent: Aug. 28, 1990

[54] ELECTRONIC MUSICAL INSTRUMENT

[75] Inventor: Satoshi Yoshida, Hamura, Japan

[73] Assignee: Casio Computer Co., Ltd., Tokyo, Japan

[21] Appl. No.: 342,742

[22] Filed: Apr. 24, 1989

[30] Foreign Application Priority Data

Apr. 26, 1988 [JP] Japan ..... 63-56238[U]
Jun. 15, 1988 [JP] Japan ..... 63-79085[U]

[51] Int. Cl.[5] ..... G10H 1/18
[52] U.S. Cl. ..... 84/646
[58] Field of Search ..... 84/615, 616, 629, 622, 84/633, 646, 653, 654, 659, 662, 665, 678, 681, 692, 705, 706, 711, 722, DIG. 30

[56] References Cited

U.S. PATENT DOCUMENTS 4,658,690 4/1987 Aitken et al. ..... 84/DIG. 30 X
4,723,468 2/1988 Takabayashi et al. ... 84/DIG. 30 X
4,748,887 6/1988 Marshall .
4,805,510 2/1989 De Dianous .

FOREIGN PATENT DOCUMENTS

WO85/02705 6/1985 PCT Int'l Appl. .
WO87/00330 1/1987 PCT Int'l Appl. .

*Primary Examiner*—W. B. Perkey
*Attorney, Agent, or Firm*—Frishauf, Holtz, Goodman & Woodward

[57] ABSTRACT

In an electronic musical instrument copying a so-called stringed instrument and capable of detecting a depression state of a fingerboard on the basis of an ON/OFF state of a plurality of contacts formed in the fingerboard and determining the pitch of a musical tone to be generated, the plurality of contacts are arranged in a single pitch unit of a pitch designation area corresponding to each string so as to detect a depression position in the pitch unit more precisely, thereby reflecting the detected depression position on an attribute of a musical tone.

27 Claims, 15 Drawing Sheets

ELECTRONIC MUSICAL INSTRUMENT

BACKGROUND OF THE INVENTION

1. Field of the Invention

The present invention relates to an electronic musical instrument copying a so-called stringed instrument and capable of detecting a depression state on a fingerboard on the basis of an ON/OFF state of a contact formed on the fingerboard and determining the pitch of a musical tone to be generated. More specifically, the present invention relates to an electronic musical instrument of this type capable of detecting a position of depression in a single pitch designation area in a direction different from the longitudinal direction of a fingerboard and changing the value of a parameter of a musical tone to be generated on the basis of this detection result, thereby realizing, with a simple arrangement, a choking effect or the like of a normal stringed instrument.

2. Description of the Related Art

The present invention also relates to an electronic musical instrument capable of detecting a position of depression in a single pitch unit of a pitch designation area in the longitudinal direction of the fingerboard and changing the value of a parameter of a musical tone to be generated on the basis of this detection result, thereby realizing, with a simple arrangement, a vibrato effect or the like of a normal stringed instrument.

An electronic musical instrument, copying a so-called stringed instrument and capable of detecting a depression state on a fingerboard on the basis of an ON/OFF state of a contact formed on the fingerboard and determining the pitch of a musical tone to be generated, has been developed.

In a conventional electronic musical instrument of this type, however, only one contact for determining the pitch of a musical tone to be generated is formed in a single pitch unit (corresponding to a fret) of a single pitch designation area (corresponding to a single string).

Therefore, even if a depression state on a fret is changed (e.g., choked or vibrated) in a single pitch unit of a single pitch designation area, such a small depression state change cannot be detected and therefore cannot be reflected on a musical tone to be generated.

The present invention has been made to eliminate the above drawback of the conventional electronic musical instrument copying a so-called stringed instrument.

SUMMARY OF THE INVENTION

It is an object of the present invention to provide an electronic musical instrument copying a so-called stringed instrument and capable of detecting a depression state on a fingerboard on the basis of an ON/OFF state of a contact formed on the fingerboard and determining the pitch of a musical tone to be generated, which can detect a position of depression in a single pitch designation area in a direction different from the longitudinal direction of the fingerboard and change the value of a parameter of a musical tone to be generated on the basis of this detection result, thereby realizing, with a simple arrangement, a choking effect or the like of a normal stringed instrument.

It is another object of the present invention to provide an electronic musical instrument copying a so-called stringed instrument and capable of detecting a depression state on a fingerboard on the basis of an ON/OFF state of a contact formed on the fingerboard and determining the pitch of a musical tone to be generated, which can detect a position of depression in a single pitch unit of a pitch designation area in the longitudinal direction of the fingerboard and change the value of a parameter of a musical tone to be generated on the basis of this detection result, thereby realizing, with a simple arrangement, a vibrato effect or the like of a normal stringed instrument.

According to an aspect of the present invention, there is provided an electronic musical instrument comprising:

a fingerboard having pitch designation areas corresponding to strings formed in a longitudinal direction thereof in a one-to-one correspondence;

first detecting means, including contacts formed in the pitch designation areas and corresponding to pitches, for detecting, when a position in the pitch designation areas is depressed, the depressed position in the longitudinal direction of the fingerboard;

second detecting means, including a plurality of contacts arranged in the pitch designation areas along a direction different from the longitudinal direction of the fingerboard, for detecting, when a position in the pitch designation areas is in the direction different from the longitudinal direction of the fingerboard is depressed, the depressed position;

pitch determining means for determining a pitch of a musical tone to be generated on the basis of a detection result of the first detecting means; and parameter value changing means for changing a value of a parameter of a musical tone to be generated on the basis of a detection result of the second detecting means.

According to an another aspect of the present invention, there is provided an electronic musical instrument comprising:

a fingerboard having pitch designation areas corresponding to strings each the areas being divided into predetermined pitch intervals in a direction different from the longitudinal direction of the fingerboard;

first detecting means, including contacts formed in units of pitches, for detecting, when a point of the pitch designation area is depressed, a pitch unit of the pitch designation area to which the depressed point belongs;

second detecting means, including a plurality of contacts arranged in the pitch unit along the longitudinal direction of the fingerboard, for detecting, when a position of the pitch designation area is depressed, the depressed position in the pitch designation area along the longitudinal direction of the fingerboard;

pitch determining means for determining a pitch of a musical tone to be generated on the basis of a detection result from the first detecting means; and parameter changing means for changing, when the pitch designation area is depressed, a value of a parameter of a musical tone to be generated, only when a depression position changes in a single pitch unit, on the basis of a detection result from the second detecting means in accordance with a component of the change in the longitudinal direction of the fingerboard.

The other aspects of the present invention will be understood from a plurality of embodiments of the present invention to be described below.

DETAILED DESCRIPTION OF THE PREFERRED EMBODIMENTS

1st Embodiment

A first embodiment of the present invention will be described below.

The first embodiment is characterized in that an absolute value of a difference between a position of depression in a pitch designation area (corresponding to a single string) in a direction perpendicular to the longitudinal direction of a fingerboard obtained instantaneously upon depression and a current position of the depression in the direction perpendicular to the longitudinal direction of the fingerboard is calculated, and the value of a parameter of a musical tone to be generated is changed on the basis of this absolute value.

Figure 1:
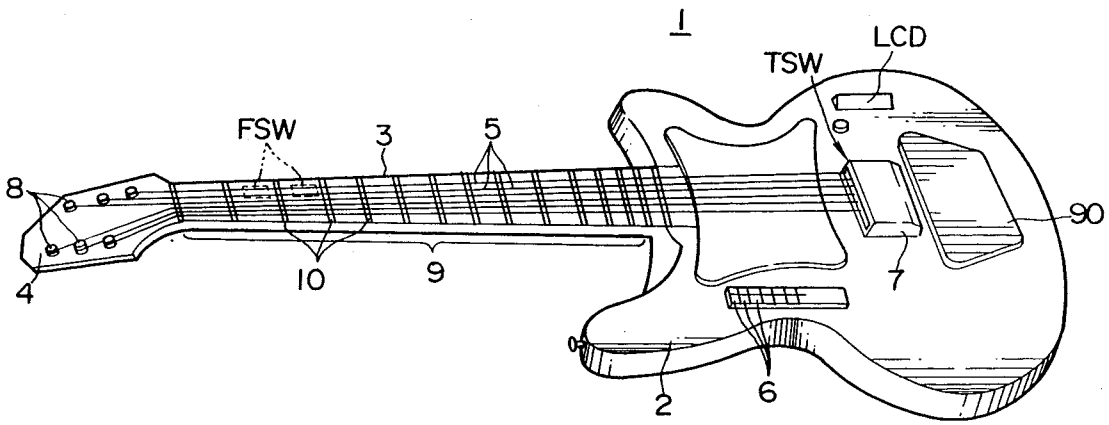
FIG. 1 is a perspective view showing an overall electronic musical instrument according to first to sixth embodiments of the present invention.

FIG. 1 shows an overall outer appearance of an electronic stringed instrument according to first to sixth embodiments of the present invention.

Figure 2:
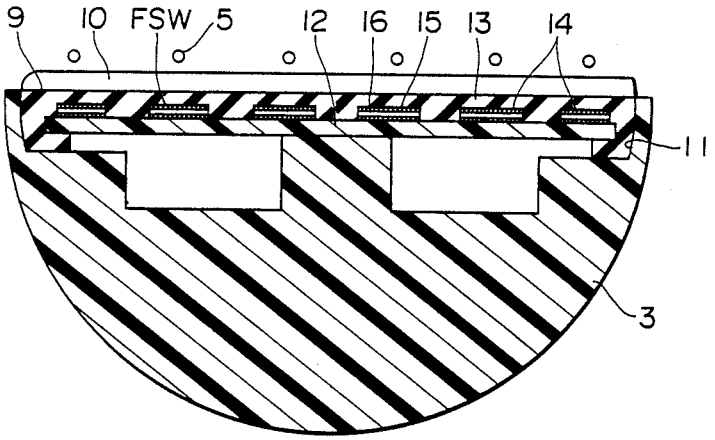
FIG. 2 is a sectional view showing a neck of an electronic stringed instrument according to the first, second and third embodiments of the present invention.
Figure 3:
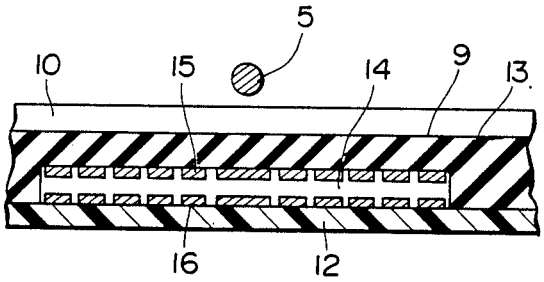
FIG. 3 is an enlarged sectional view showing an FSW in FIG. 2.

Referring to FIG. 1, an electronic stringed instrument 1 comprises a body 2, a neck 3 and a head 4 and has a shape like a guitar. A plurality of strings 5 for performing the musical instrument are extended along the neck 3. Parameter switches 6 for setting various parameters and a loudspeaker 90 for generating a musical tone are arranged on the body 2. One end of each string 5 is supported by a corresponding peg 8 fitted in the head 4 so that its tension can be adjusted. The other end of the string extends along a fingerboard 9 formed on the surface of the neck 3 and is fixed in a string trigger switch unit 7 on the body 2. Fret switches FSW are arranged in a matrix manner in the fingerboard 9. When the string 5 between frets 10 formed on the surface of the fingerboard 9 in a string taut direction is depressed and urged against the surface of the fingerboard 9, a corresponding fret switch FSW is turned on. String trigger switches TSW are housed in the string trigger switch unit 7, and the strings 5 are connected to the string trigger switches TSW. When the string 5 is picked or finger-plucked, a corresponding string trigger switch TSW is turned on, thereby generating a musical tone. The fret switches FSW embedded in the fingerboard 9 at portions between the frets 10 are arranged as shown in FIG. 2. That is, the fret switch FSW comprises a printed circuit board 12 and a rubber sheet 13 fitted in a recess portion 11 formed in the upper surface of the neck 3, i.e., the fingerboard 9. The rubber sheet 13 is stacked and adhered on the printed circuit board 12. Both ends of the rubber sheet 13 are bent in a U shape to hold both ends of the circuit board 12, thereby fixing the circuit board 12. Contact recess portions 14 are formed at a position corresponding to each string 5 on the lower surface of the rubber sheet 13 in contact with the upper surface of the circuit board 12. In this case, as shown in FIG. 3, n arrays (if the number of strings is six as in a guitar, the total number of fret arrays is 6n) of the contact recess portions 14 are formed in a direction perpendicular to the longitudinal direction of the neck 3, i.e., the string taut direction per area (corresponding to an oscillation range of the string 5) corresponding to a single string 5. Note that in this embodiment, n (the number of fret arrays per string) is an odd number. In addition, the contact recess portion 14 located at the center of the n arrays of contact recess portions 14 corresponding to a single string 5, i.e., located immediately below [$(n+1)/2$)th array] of the string 5 is formed wider than the other contact recess portions 14. An electrode 15 is patterned as a movable contact on the upper bottom surface of each recess portion 14. An electrode 16 is patterned as a stationary contact on the circuit board 12 opposite to each electrode 15. The fret switch FSW for designating a predetermined pitch is constituted by the electrodes 15 and 16. Therefore, when the rubber sheet 13 as the surface of the fingerboard 9 is depressed from above the string 5, the electrodes 15 and 16 electrically contact with each other to turn on the fret switch FSW.

Figure 4:
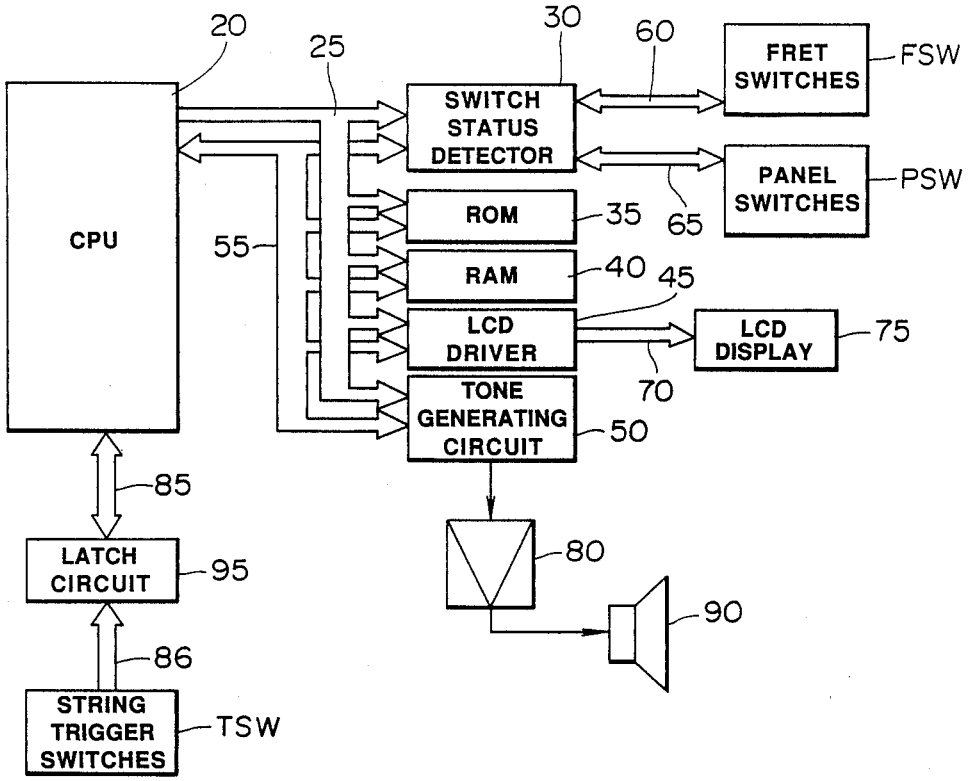
FIG. 4 is a block diagram showing an overall circuit arrangement of the electronic stringed instrument in FIG. 1.

FIG. 4 shows a circuit arrangement of the electronic stringed instrument comprising the fret switches FSW, panel switches PSW and the like.

Referring to FIG. 4, a CPU 20 is connected to a switch status detector 30, a ROM 35, a RAM 40, an LCD driver 45 and a musical tone generator 50 via an address bus 25. Data of the detector 30, the ROM 35, the RAM 40, the driver 45 and the generator 50 are supplied to the CPU 20 through a data bus 55. The detector 30 is connected to the fret switches (FSW) and the panel switches (PSW) via bus lines 60 and 65, respectively. The driver 45 is connected to an LCD display unit 75 via a bus line 70. A musical tone signal generated by the generator 50 is generated as a tone from the loudspeaker 90 via an amplifier 80. The CPU 20 is also connected to a latch circuit 95 via a bus line 85. The latch circuit 95 is connected to the string trigger switches (TSW) via a bus line 86.

Therefore, an ON input signal output from the string trigger switches (TSW) upon picking or finger-plucking a string is latched by the latch circuit 95. The CPU 20 performs trigger detection of the strings 5 via the circuit 95. A switch state of each fret switch (FSW) and an input state of each panel switch (PSW) (the parameter setting switch 6 shown in FIG. 1) are supplied to the detector 30 and fetched by the CPU 20 via the detector 30. The generator 50 is controlled by the CPU 20 to generate a musical tone signal corresponding to a musical tone specified by the CPU 20. The generated musical tone signal is amplified by the amplifier 80 and generated as a tone from the loudspeaker 90.

Figure 5:
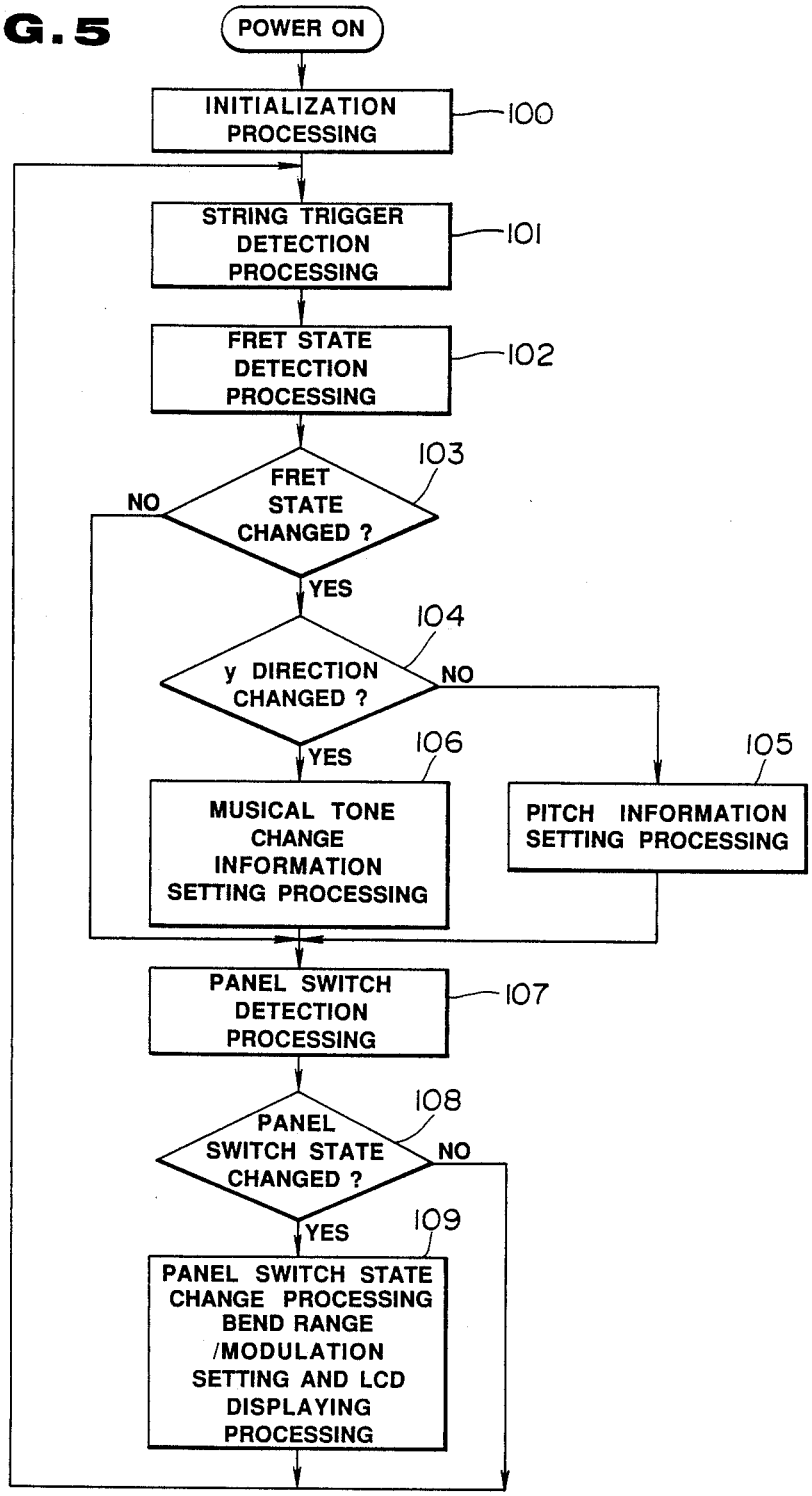
FIG. 5 is a flow chart for explaining an operation of the electronic stringed instrument according to the first, second and third embodiments of the present invention.

Calculations performed by the CPU 20 shown in FIG. 4 will be described below with reference to a processing flow chart shown in FIG. 5.

When a power source is switched on, initialization is performed in step 100. In step 101, the CPU 20 reads out information latched by the latch circuit 95 shown in FIG. 4 and checks, for all the strings, the presence/absence of triggering on a string, i.e., the presence/absence of detection of a picking operation state representing whether a picking operation of a string is performed. If a triggered string is detected from the strings 5 shown in FIG. 1 in step 101, the CPU 20 controls the generator 50 to generate a musical tone. In step 102, the CPU 20 executes fret state detection processing. In the fret state detection processing in step 102, the CPU 20 fetches data concerning a state of each of fret switches (FSW) for each string via the detector 30 shown in FIG. 4. In step 103, the CPU 20 checks whether a so-called fret state representing whether the fret switches (FSW) are turned on has changed from a preceding fret state. If the CPU 20 determines that the fret state has not changed from the preceding fret state, the flow advances to step 107. If the CPU 20 determines in step 103 that the fret state has changed from the preceding fret state, it checks in step 104 whether the fret state changes in a direction (y direction) perpendicular to the string taut direction of the strings 5. If the CPU 20 determines in step 104 that the fret state has not changed in the direction (y direction) perpendicular to the string taut direction of the strings 5, i.e., that the fret state has changed in the same direction (x direction) as the string taut direction of the strings 5, it executes pitch information setting processing in step 105, and the flow advances to step 107. If the CPU 20 determines in step 104 that the fret state has changed in the direction (y direction) perpendicular to the string taut direction of the strings 5, it executes musical tone change information setting processing, i.e., processing of instructing frequency change to the generator 50, and the flow advances to step 107. Note that if the fret state changes to a state representing all the fret switches FSW belonging to a string currently generating a musical tone are released, i.e., changes to a so-called open string state, the CPU 20 performs sound arrest. The CPU 20 does not perform processing for a string depression state change in fret switches FSW belonging to a string currently not generating a musical tone. In this manner, the CPU 20 checks the fret state change in the fret state change processing in steps 103 and 104.

In step 107, the CPU 20 reads out data concerning a state of each parameter setting switch as the panel switch (PSW) shown in FIG. 4 via the detector 30. In step 108, the CPU 20 checks whether the state of each parameter setting switch as the panel switch (PSW) detected in step 107 has changed. If the CPU 20 determines in step 108 that the state of no parameter setting switch as the panel switch (PSW) has changed, the flow returns to step 101. If the CPU determines in step 108 that the state of any parameter setting switch as the panel switch (PSW) has changed, it executes panel switch state change processing in step 109. In the panel switch state change processing in step 109, for example, a tone color, modulation data and a band range are set, and LCD display is performed.

Of the above series of processing tasks, the processing tasks from the fret state detection to the musical tone change information setting processing executed when the fret state changes in the direction (y direction) perpendicular to the string taut direction of the strings 5 shown in FIG. 5 will be described in detail below with reference to a flow chart shown in FIG. 6. In this processing, a 6-stringed electronic musical instrument is exemplified. The processing is performed for each fret state of each string of this electronic stringed instrument. As shown in FIGS. 1 to 3, n arrays (if the number of strings is six as in a guitar, the total number of fret arrays is 6n) of the contact recess portions 14 are formed in each area (oscillation range of the string 5) corresponding to a single string 5 in the direction perpendicular to the longitudinal direction, i.e., the string taut direction of the neck 3. Each contact recess portion 14 serves as a switch for detecting the fret state. That is, as shown in FIG. 7, n fret arrays are formed for each string of the six strings. Each of the n fret arrays is divided into a plurality of (M) frets by a plurality of frets 10 arranged in the direction perpendicular to the longitudinal direction, i.e., the string taut direction of the neck 3 shown in FIG. 1. That is, M blocks of fret arrays are formed.

Therefore, in step 200, a string (having a string number k) is designated, i.e., a first string (k=1) is designated. After the string number (k=1) is designated in step 200, a fret array number of the n fret arrays corresponding to the first string (k=1) is designated in step 201. That is, in step 201, a fret array number (n=1) of the first array is designated (fret array n=1 shown in FIG. 7). After the fret array number is designated, in step 202, the CPU 20 checks whether any of the fret switches FSW, of the fret array having the designated fret number, corresponding to each of the M fret blocks divided by a plurality of frets 10 arranged in the direction perpendicular to the longitudinal direction, i.e., the string taut direction of the neck shown in FIG. 1 is turned on. That is, the CPU 20 checks whether string depression is present on any position of the array of the designated fret array number, i.e., the array of the designated fret array number represents an open string. If the CPU 20 determines in step 202 that none of the fret switches FSW corresponding to the designated fret array number is turned on, it sets a 0-fret state ON (open-string state) representing an open-string state in step 203. If the CPU 20 determines in step 202 that an of the fret switches FSW corresponding to the designated fret array number is turned on, it checks in step 204 whether the fret position number of the currently-ON fret switch FSW is the same as that of a preceding-ON fret switch FSW. If the CPU 20 determines in step 204 that the fret position number of the currently-ON fret switch FSW differs from that of the precedingly-ON fret switch FSW, in step 205, it sets pitch information corresponding to the fret position number of this changed fret switch FSW and initializes musical tone change information (pitch bend information, modulation information and the like), and the flow advances to step 209. If the CPU 20 determines in step 204 that the fret position number of the currently-ON fret switch FSW is the same as that of the precedingly-ON fret switch FSW, it checks in step 206 whether the fret array number (n=1) of the fret switch FSW at the currently-ON fret position number (e.g., M=1) is the same as the fret array number (n) of the fret switch FSW at the precedingly-ON fret position number (in this case, e.g., M=1) at the designated fret array number (n=1) of fret switches FSW. If the CPU 20 checks in step 206 that the fret array number (n=1) of the fret switch FSW at the currently-ON fret position number (e.g., M=1) is the same as the fret array number (n) of the fret switch FSW at the precedingly-ON fret position number (e.g., M=1) at the designated fret array number (n=1) of fret switches FSW, the flow advances to step 209. If the CPU 20 determines in step 206 that the fret array number (n=1) of the fret switch FSW at the currently-ON fret position number (e.g., M=1) differs from the fret array number (e.g., n=3) at the precedingly-ON fret position number (e.g., M=1) at the designated fret array number (n=1) of fret switches FSW, in step 207, it calculates an absolute value of a difference between the fret array number (n=3) of the fret switch FSW obtained instantaneously upon ON operation of the fret switch FSW at the fret position number (e.g., M=1) and the fret array number (n=1) of the currently-ON fret switch FSW. In step 208, the CPU 20 sets musical tone change information on the basis of the absolute value calculated in step 207. That is, for example, if the fret array number (n=3) at the fret position number (M=1, i.e., an Mth fret shown in FIG. 7) is turned on for the fret array number (n=3) of the fret switches FSW of the preceding string number (k=1) and then a different fret array number (n=1) is turned on for the fret position number (M=1, the Mth fret shown in FIG. 7) of the same string number k=1), this corresponds to a normal guitar performance in which a finger depressing a string is moved in a direction perpendicular to the string while it depresses the string. Similar to this normal performance, in steps 207 and 208, the absolute value of the difference between the fret array number of the fret switch FSW obtained instantaneously upon ON operation of the fret switch FSW at the fret position number M=1) and the current fret array number is calculated, and the characteristic of a musical tone, e.g., a frequency (or parameter for determining a tone color, a volume, tremolo or the like) is changed on the basis of the absolute value.

In step 209, the fret array number (n) is incremented (n=n+1). In step 210, the CPU 20 checks whether a change state of the fret array number has been checked for all the fret array numbers (n=1 to n=5 shown in FIG. 7) of a single string. If the CPU 20 determines that all the fret array numbers have been checked, the flow advances to step 211. In step 211, the string number is incremented (k=k+1). In step 212, the CPU 20 checks whether the processing has been performed for all the strings. The processing is cyclically performed for all the frets of all the strings. When all the frets of all the strings are completely processed, the flow is ended. It is a matter of course that the processing of this flow is repeatedly performed at a predetermined cycle.

Effects of the 1st Embodiment

According to the first embodiment, in an electronic stringed instrument, if a string is changed in a direction perpendicular to a string taut direction, effects similar to those of a traditional stringed instrument can be additionally obtained.

2nd Embodiment

A second embodiment of the present invention will be described below.

The second embodiment is characterized in that when a pitch designation area (corresponding to a single string) is depressed and the depression position moves in a direction perpendicular to the longitudinal direction of a fingerboard, a differential value between positions of the depression in the direction perpendicular to the longitudinal direction of the fingerboard before and after the movement is calculated, and the value of a parameter of a musical tone to be generated is changed on the basis of the differential value.

The second embodiment is completely the same as the above first embodiment in its circuit arrangement and differs therefrom in only its processing. Therefore, only a processing flow chart (see FIG. 8) which is a feature of the second embodiment will be described below.

Figure 6:
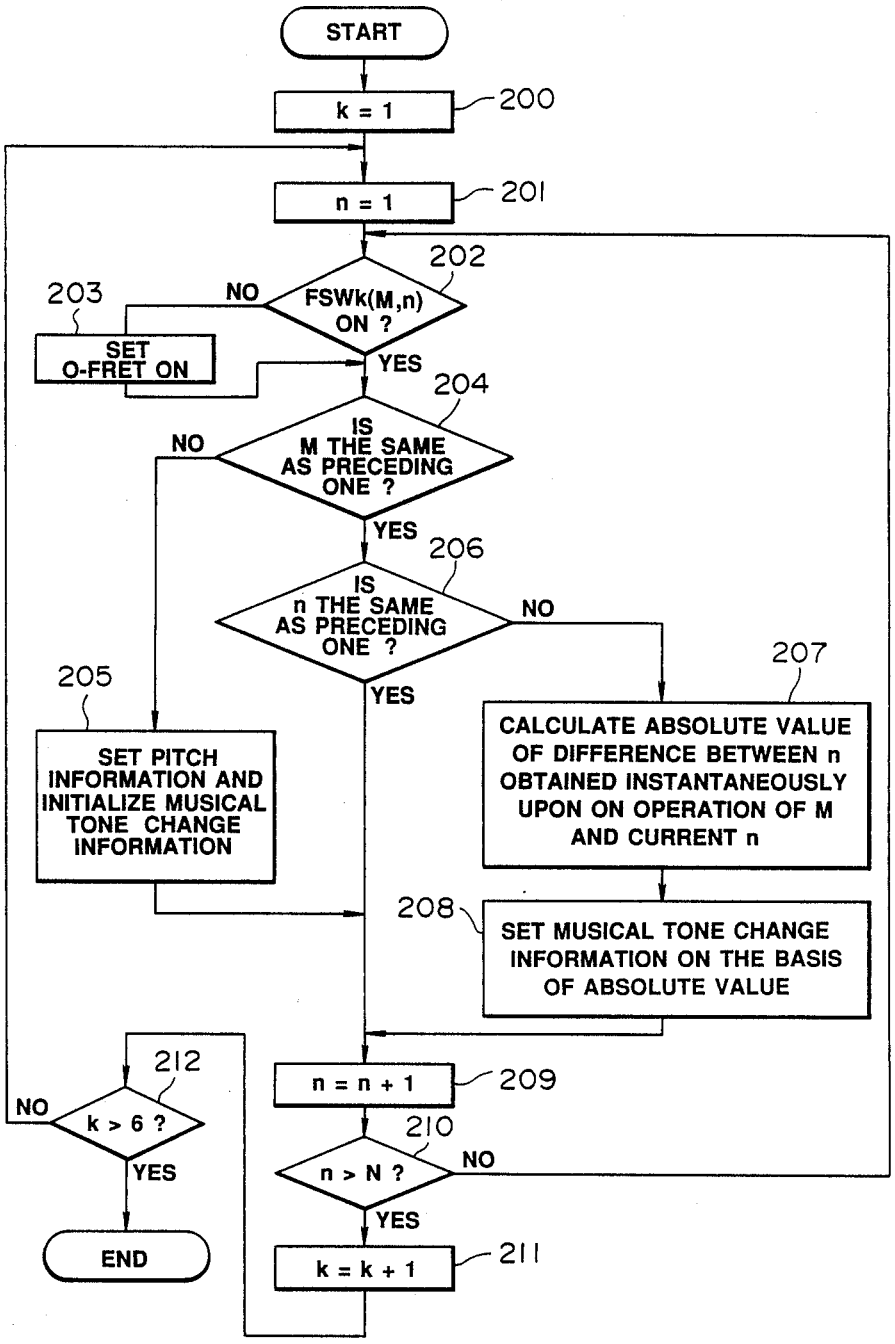
FIG. 6 is a flow chart for explaining processing tasks from fret state detection to musical tone change information setting of the electronic stringed instrument according to the first embodiment of the present invention.
Figure 7:
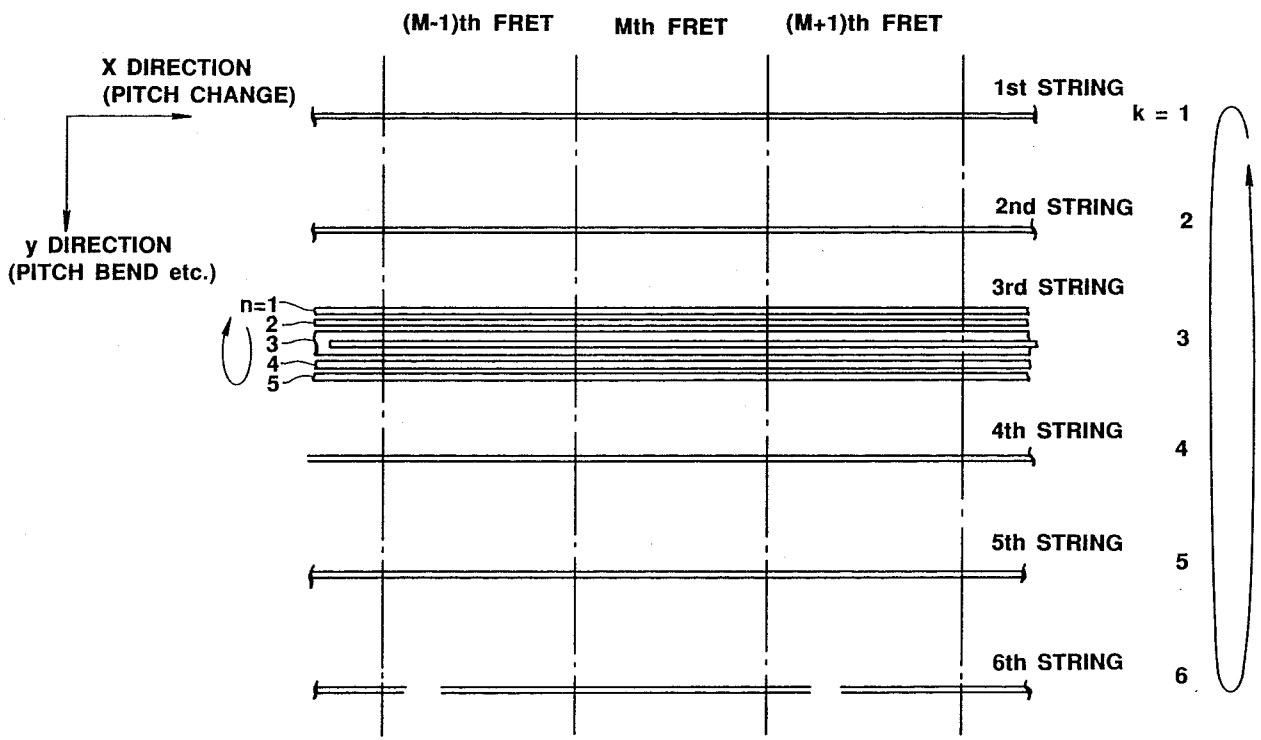
FIG. 7 is a view for explaining flow charts shown in FIGS. 8 and 9.
Figure 8:
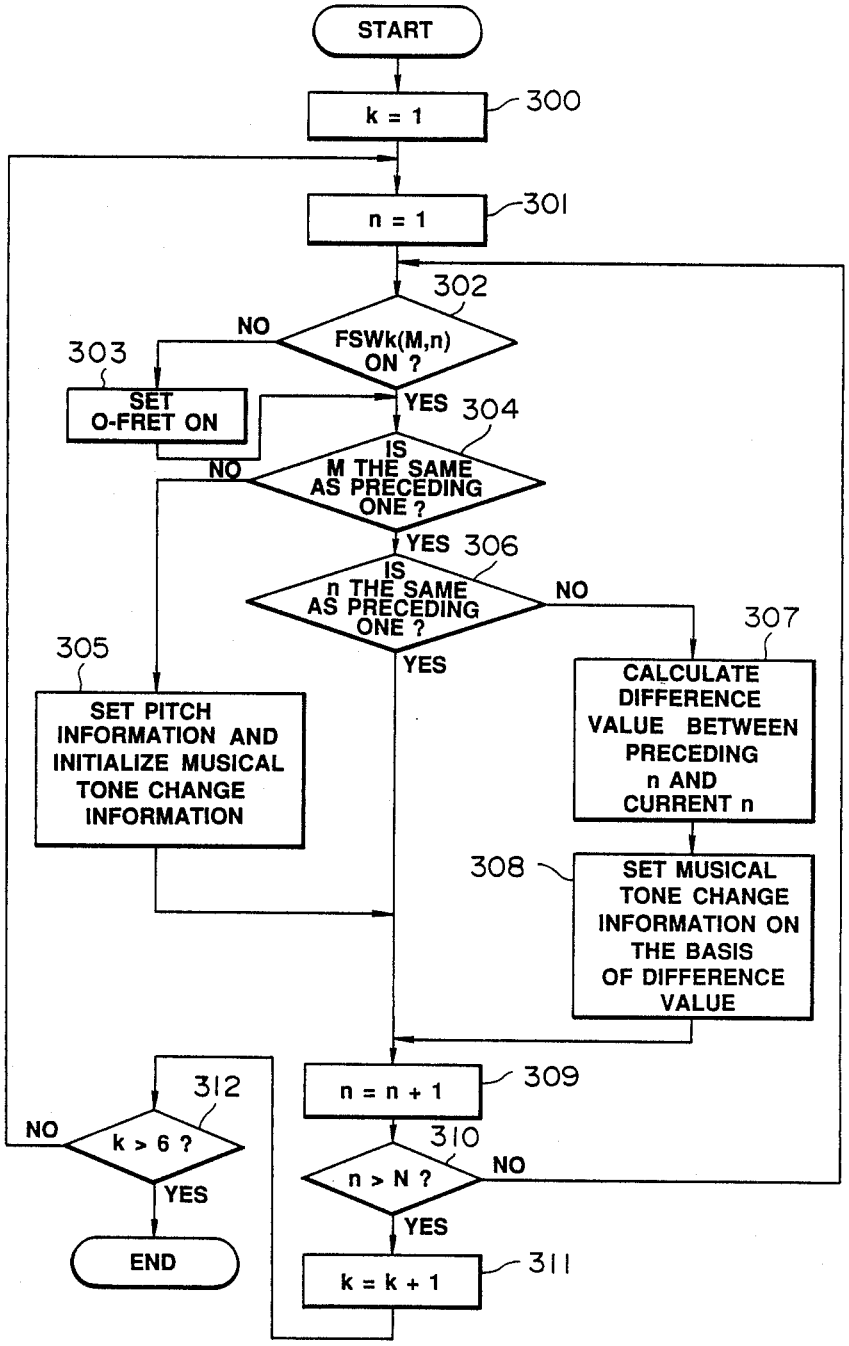
FIG. 8 is a flow chart for explaining processing tasks from fret state detection to musical tone change information setting of the electronic stringed instrument according to the second embodiment of the present invention.

FIG. 8 is a processing flow chart showing the feature of the second embodiment and corresponds to FIG. 6 of the first embodiment. FIG. 8 differs from FIG. 6 in only steps 307 and 308.

That is, in steps 207 and 208 of the first embodiment, the value of a parameter of a musical tone to be generated is changed on the basis of an absolute value of a difference between a fret array number (n) of a fret switch FSW obtained instantaneously upon ON operation of the fret switch FSW and a fret array number (n) of a currently-ON fret switch FSW. According to the second embodiment, however, in steps 307 and 308 shown in FIG. 8, the value of a parameter of a musical tone to be generated is changed on the basis of a differential value between a fret array number (n) of a precedingly-ON fret switch FSW and a fret array number (n) of a currently-ON fret switch FSW.

Effects of the 2nd Embodiment

According to the second embodiment, in an electronic stringed instrument, if a string is changed in a direction perpendicular to a string taut direction during performance, unique effects which cannot be obtained by a traditional stringed instrument can be additionally obtained.

3rd Embodiment

A third embodiment of the present invention will be described below.

The third embodiment is characterized in that when a pitch designation area (corresponding to a single string) is depressed, an absolute value of a difference between a reference position ($n+\frac{1}{2}$) in a direction perpendicular to the longitudinal direction of a fingerboard and a current position of the depression in the direction perpendicular to the longitudinal direction of the fingerboard is calculated, and the value of a parameter of a musical tone to be generated is changed on the basis of the absolute value.

The third embodiment is also the same as the above first embodiment in its circuit arrangement and differs therefrom in only its processing. Therefore, only a processing flow chart (see FIG. 9) as a feature of the third embodiment will be described below.

Figure 9:
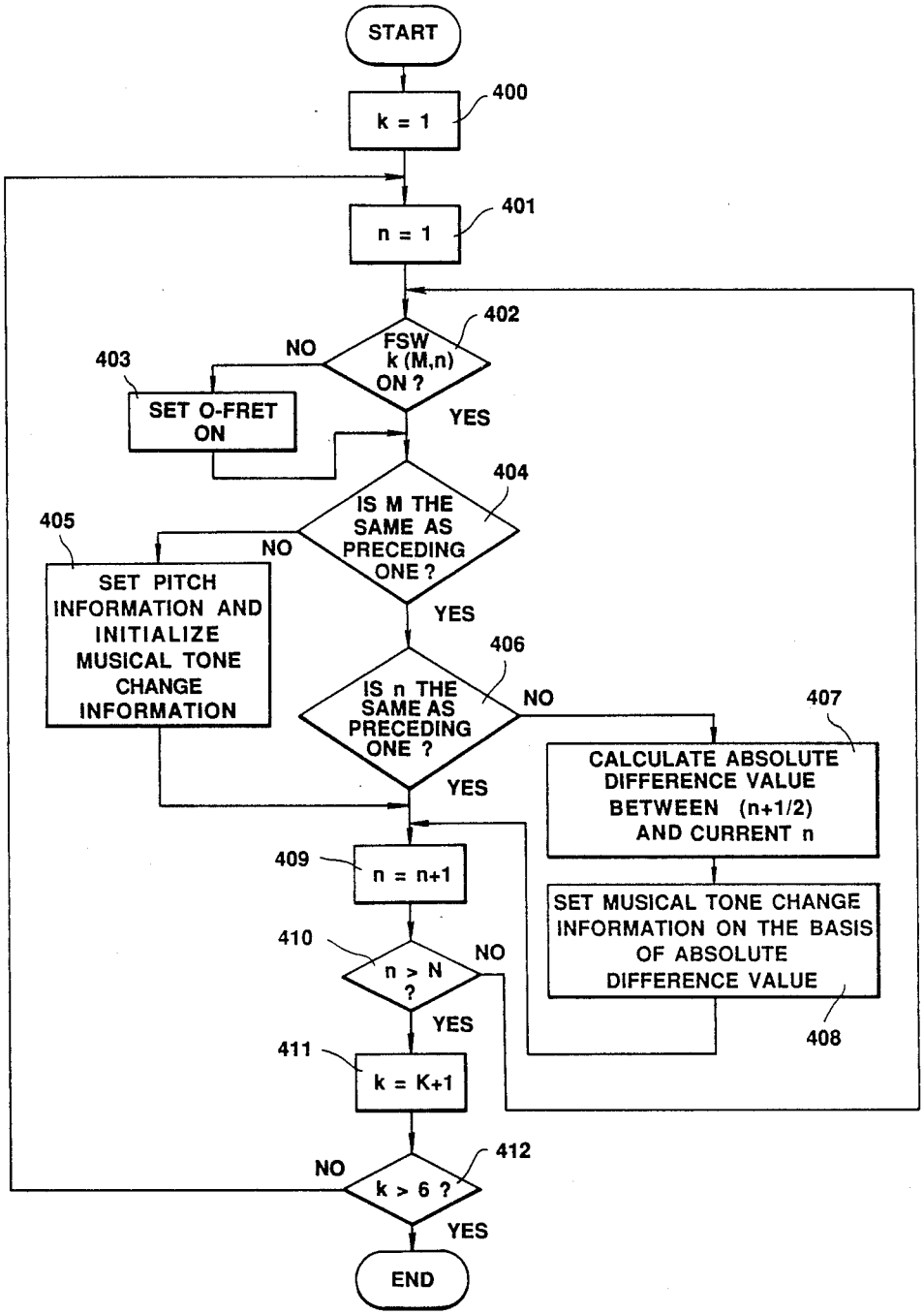
FIG. 9 is a flow chart for explaining processing tasks from fret state detection to musical tone change information setting of the electronic stringed instrument according to the third embodiment of the present invention.

FIG. 9 is a processing flow chart showing the feature of the third embodiment and corresponds to FIG. 6 of the first embodiment. FIG. 9 differs from FIG. 6 in only steps 407 and 408.

That is, in steps 207 and 208 shown in FIG. 6 of the first embodiment, the value of a parameter of a musical tone to be generated is changed on the basis of an absolute value of a difference between a fret array number (n) of a fret switch FSW obtained instantaneously upon ON operation of the fret switch FSW and a fret array number (n) of a currently-ON fret switch FSW. According to the third embodiment, however, in steps 407 and 408 shown in FIG. 9, the value of a parameter of a musical tone to be generated is changed on the basis of an absolute value of a difference between a fret array number ($n+\frac{1}{2}$) as a reference of an area (corresponding to an oscillation range of a string 5) corresponding to a string number (k) and a fret array number (n) of a currently-ON fret switch FSW.

Effects of the 3rd Embodiment

According to the third embodiment, in an electronic stringed instrument, if a string is changed in a direction perpendicular to a string taut direction during performance, various effects can be additionally provided for a musical tone with a feeling very close to that of a traditional stringed instrument.

4th Embodiment

A fourth embodiment of the present invention will be described below.

The fourth embodiment is characterized in that if a single pitch unit (single fret position number) of a pitch designation area (corresponding to a single string) is depressed, the value of a parameter of a musical tone to be generated is changed, only when a depression position of the depression continuously changes in the single pitch unit, on the basis of a component of the change in the longitudinal direction of a fingerboard.

The fourth embodiment is the same as the above first to third embodiments in its circuit arrangement (see FIG. 4) and differs therefrom in only an arrangement of a fret switch FSW and its operation and processing. Therefore, only the arrangement (see FIGS. 10 and 11) of the fret switch FSW, an operation flow chart (see FIG. 12) and a processing flow chart (FIG. 13) will be described below.

Figure 10:
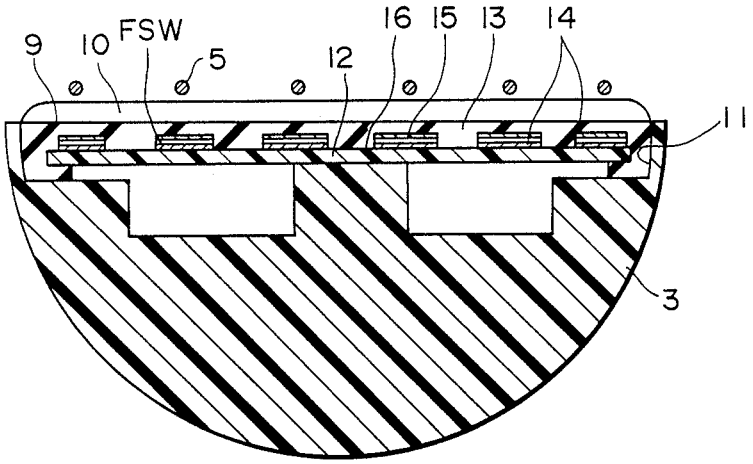
FIG. 10 is a sectional view of a neck of an electronic stringed instrument according to the fourth, fifth and sixth embodiments of the present invention.
Figure 11:
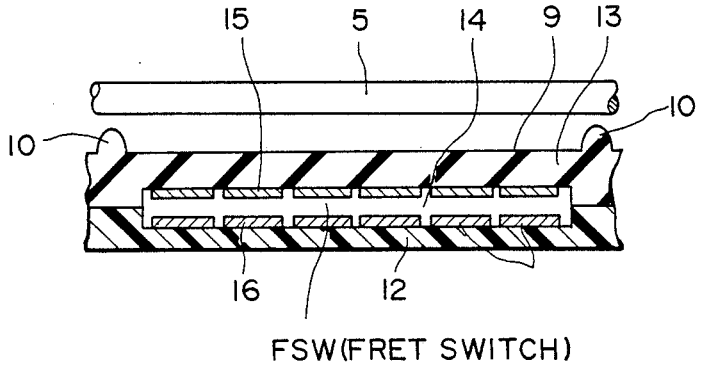
FIG. 11 is an enlarged sectional view showing an FSW in FIG. 10.

FIGS. 10 and 11 are views common for fourth to six embodiments, in which FIG. 10 is a sectional view of a neck of an electronic stringed instrument, and FIG. 11 is an enlarged sectional view of the fret switch FSW.

As shown in FIG. 10, a printed circuit board 12 and a rubber sheet 13 are fitted and fixed in a recess portion 11 formed in the upper surface of a neck 3, i.e., a fingerboard 9. The rubber sheet 13 is stacked and adhered on the printed circuit board 12. Both ends of the rubber sheet 13 are bent in a U shape to hold both ends of the circuit board 12 and fix the circuit board 12. Contact recess portions 14 are formed at positions corresponding to each string 5 on the lower surface of the rubber sheet 13 in contact with the upper surface of the circuit board 12. That is, as shown in FIG. 11, one string depression position switch array (if the number of strings is six as in a guitar, the total number of string depression position switch arrays is six with respect to six strings in an area corresponding to one fret interval) of contact recess portions is formed per area corresponding to one fret interval of each string 5 along the longitudinal direction of the neck 3, i.e., a string taut direction. A plurality of contact recess portions 14 of a string depression position switch array corresponding to one fret interval of each string 5 have the same width. As shown in FIG. 10, an electrode 15 is patterned as a movable contact on the upper bottom surface of each contact recess portion 14 corresponding to each string 5. An electrode 16 is patterned as a stationary contact on the printed circuit board 12 opposite to each electrode 15. The fret switch FSW for designating a predetermined pitch is constituted by the electrodes 15 and 16. Therefore, when the rubber sheet 13 as the surface of the fingerboard 9 is depressed from above the string 5, the electrodes 15 and 16 are electrically brought into contact with each other to turn on the fret switch FSW.

Figure 12:
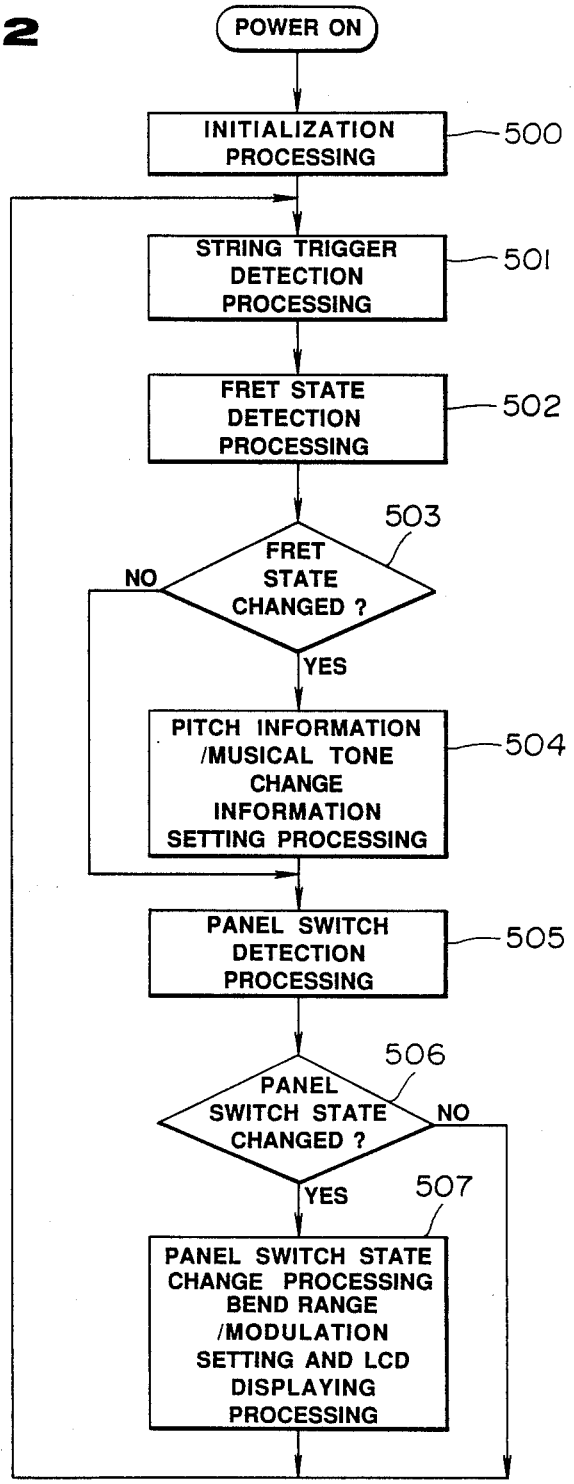
FIG. 12 is a flow chart for explaining an operation of the electronic stringed instrument according to the fourth, fifth and sixth embodiments of the present invention.

An operation of the fourth embodiment will be described below with reference to an operation flow chart shown in FIG. 12.

When a power source is switched on, initialization is performed in step 500. After the initialization is finished in step 500, in step 501, a CPU 20 reads out information latched by a latch circuit 95 shown in FIG. 4 and checks, for all the strings 5 shown in FIG. 1, the presence/absence of triggering, i.e., the presence/absence of detection of a picking operation state representing whether a picking operation is performed for a string. If a triggered string is detected from the strings 5 shown in FIG. 1 in step 501, the CPU 20 controls a musical tone generator 50 to generate a musical tone. In step 502, the CPU 20 executes fret state detection processing. In the fret state detection processing in step 502, the CPU 20 fetches data concerning states of the fret switches (FSW) for each string via a switch status detector 30 shown in FIG. 4. In step 503, the CPU 20 checks whether a so-called fret state, representing whether the fret switches FSW are turned on, has changed from a preceding fret state to a current fret state. If the CPU 20 determines in step 503 that the fret state has not changed from the preceding state, the flow advances to step 505. If the CPU 20 determines in step 503 that the fret state has changed from the preceding fret state, it executes pitch information/musical tone change information setting processing for the generator 50 in step 504, and the flow advances to step 505. Note that if the fret state changes to a state in which all of the fret switches FSW belonging to a string currently generating a musical tone are released, i.e., changes to a so-called open-string state, the CPU 20 performs sound arrest. The CPU 20 does not perform any processing for a string depression state change with respect to fret switches FSW belong to a string currently not generating a musical tone. In this manner, if the fret state changes in the fret state change processing and the pitch information/ musical tone information setting processing in steps 503 and 504, the CPU 20 executes the pitch information/ musical tone change information setting processing corresponding to the changed state.

In step 505, the CPU 20 reads out data concerning the state of each parameter setting switch as the panel switch PSW shown in FIG. 4 via a switch status detector 30. In step 506, the CPU checks whether the state of each parameter setting switch as the panel switch PSW detected in step 505 has changed. If the CPU 20 determines in step 506 that the state of no parameter setting switch of the panel switches PSW has changed, the flow returns to step 501. If the CPU 20 determines in step 506 that the state of any parameter setting switch of the panel switches PSW has changed, it executes panel switch state change processing in step 507. In the panel switch state change processing in step 507, for example, a tone color, modulation data and a bend range are set, and LCD display is performed.

Of the above series of processing tasks, the processing tasks from the fret state detection to the musical tone change information setting processing executed when the fret state changes along the string taut direction of the strings 5 shown in FIG. 1 in step 503 will be described in detail below with reference to a processing flow chart shown in FIG. 13. In the processing, a 6-stringed electronical musical instrument is exemplified. The processing is performed for each fret state of each of all the strings of this electronic stringed instrument. As shown in FIGS. 1, 10 and 11, a plurality of fret switches FSW as a fret state detecting means are arranged between frets corresponding to each string in the longitudinal direction of the neck 3, i.e., the string taut direction. Between the fret switches FSW, N fret operation position switch arrays $FSW_3$ . . . are formed in the contact recess portions 14 for each fret. That is, as shown in FIG. 14, this electronic stringed instrument has an array of the fret operation position switches $FSW_3$ . . . for each of the six strings. The switch arrays $FSW_3$ . . . are divided into a plurality of (M) fret operation position switches ($FSW_3$) . . . by a plurality of frets 10 arranged in the longitudinal direction of the neck 3 shown in FIG. 1, i.e., the string taut direction. That is, M blocks of the fret operation position switches $FSW_3$ are formed for each string.

In this arrangement, the CPU 20 designates a string (having a string number k) in step 600. That is, a first string k=1) is designated. After the string number (k=1) is designated in step 600, the CPU checks in step 601 whether any of the fret switches FSW arranged in correspondence with each of fret intervals divided into M blocks by a plurality of frets 10 arranged along the longitudinal direction of the neck 3 shown in FIG. 1, i.e., the string taut direction of the designated string array number is turned on. That is, the CPU 20 checks whether a string depression position is present in any of the fret switches FSW corresponding to the designated string, i.e., whether the designated string is an open string. If the CPU 20 determines in step 601 that none of the fret switches FSW corresponding to the designated string is turned on, it sets a O-fret state ON (open-string state) representing an open-string state) in step 602. If the CPU 2 determines in step 601 that any of the fret switches FSW corresponding to the designated string is turned on, it checks in step 603 whether the fret position number (M) of the currently-ON fret switch FSW is the same as the fret position number of a precedingly-ON fret switch FSW. If the CPU 20 determines in step 603 that the fret position number of the currently-ON fret switch FSW differs from that of the precedingly-ON fret switch FSW, in step 604, it sets pitch information corresponding to the changed fret position number of the fret switch FSW and initializes pitch change information (pitch bend information, modulation information, and the like), and the flow advances to step 608. If the CPU 20 determines in step 603 that the fret position number of the currently-ON fret switch FSW is the same as that of the precedingly-ON fret switch FSW, it checks in step 605 whether the string depression position detected by a plurality of fret operation position detection switches $FSW_3$ arranged in the string taut direction of the precedingly-depressed string in one fret position (the same pitch unit) is the same as the string depression position currently detected by the fret operation position detection switch $FSW_3$, i.e., whether the string depression position of the precedingly-switched fret operation position detection switch $FSW_3$ is the same as the string depression position of the currently-switched fret operation position selection switch $FSW_3$. If the CPU 20 determines in step 605 that the currently-ON string depression position number is the same as the precedingly-ON string depression position number, the flow advances to step 608.

If the CPU 20 determines in step 605 that the currently-ON string depression position number (e.g., n=3) (indicated by a black dot in FIG. 14) differs from the precedingly-ON string depression position number (e.g., n=1) (indicated by a broken line dot in FIG. 14), in step 606, it calculates a difference between the string depression position number (n=3) of the precedingly-ON fret operation position detection switch FSW3 and the string depression position number (n=1) of the currently-ON fret operation position detection switch $FSW_3$, thereby calculating a change amount, i.e., a differential value therebetween. In step 607, the CPU 20 sets musical tone change information based on the differential value, calculated in step 606, between the string depression position number (n=3) of the precedingly-ON fret operation position detection switch $FSW_3$ and the string depression position number (n=1) of the currently-ON fret operation position detection switch $FSW_3$. That is, when the string depression position number (n=3) of the fret position number (M=1, i.e., an Mth fret shown in FIG. 14) is turned on for the string depression position number (n=3) of the fret operation position detection switch $FSW_3$ having the preceding string number k=1) and then a different string depression position number n=1) is turned on for the fret position number M=1, i.e., the Mth fret shown in FIG. 14) having the same string number k=1), this corresponds to a so-called vibrato performance of one of normal guitar performances in which a finger depressing a string is finely moved in the string taut direction in the same fret while it depresses the string. When the finger depressing the string is finely moved in the string taut direction while it depresses the string, the pitch of a musical tone being generated, i.e., the frequency of the musical tone is finely changed. Therefore, similar to the so-called vibrato performance, in steps 606 and 607, the change state from the preceding to current string depression position number is detected, and the characteristic of a musical tone, e.g., a frequency (or a parameter for determining a tone color, a volume, tremolo or the like) is changed on the basis of the change amount (differential value).

In step 608, the string number is incremented (k=k+1). In step 609, the CPU 20 checks whether the processing has been performed for all the strings. The CPU 20 cyclically executes the processing for all the strings of all the frets. When all the frets of all the strings are completely processed, the flow is ended. It is a matter of course that the processing of this flow is repeatedly executed at a predetermined cycle.

Effects of the 4th Embodiment

According to the fourth embodiment, in an electronic stringed instrument, when a so-called vibrato performance in which a finger is finely moved in a string taut direction, not only the pitch of a musical tone can be changed in accordance with the movement, but also the value of a parameter for determining various characteristics of a musical tone can be changed. Therefore, the musical instrument can be performed with a musical tone having different characteristics from those of a musical tone obtained by traditional stringed instrument.

5th Embodiment

A fifth embodiment of the present invention.

The fifth embodiment of the present invention is characterized in that when a single pitch unit (single fret position number) of a pitch designation area (corresponding to a single string) is depressed, a differential value between a position in the longitudinal direction of a fingerboard in the single pitch unit obtained instantaneously upon depression and a current position in the longitudinal direction of the fingerboard in the same pitch unit is calculated, and the value of a parameter of a musical tone to be generated is changed on the basis of the differential value.

The fifth embodiment differs from the fourth embodiment in only its processing. Therefore, only a processing flow chart (see FIG. 15) as a feature of the fifth embodiment will be described below.

Figure 13:
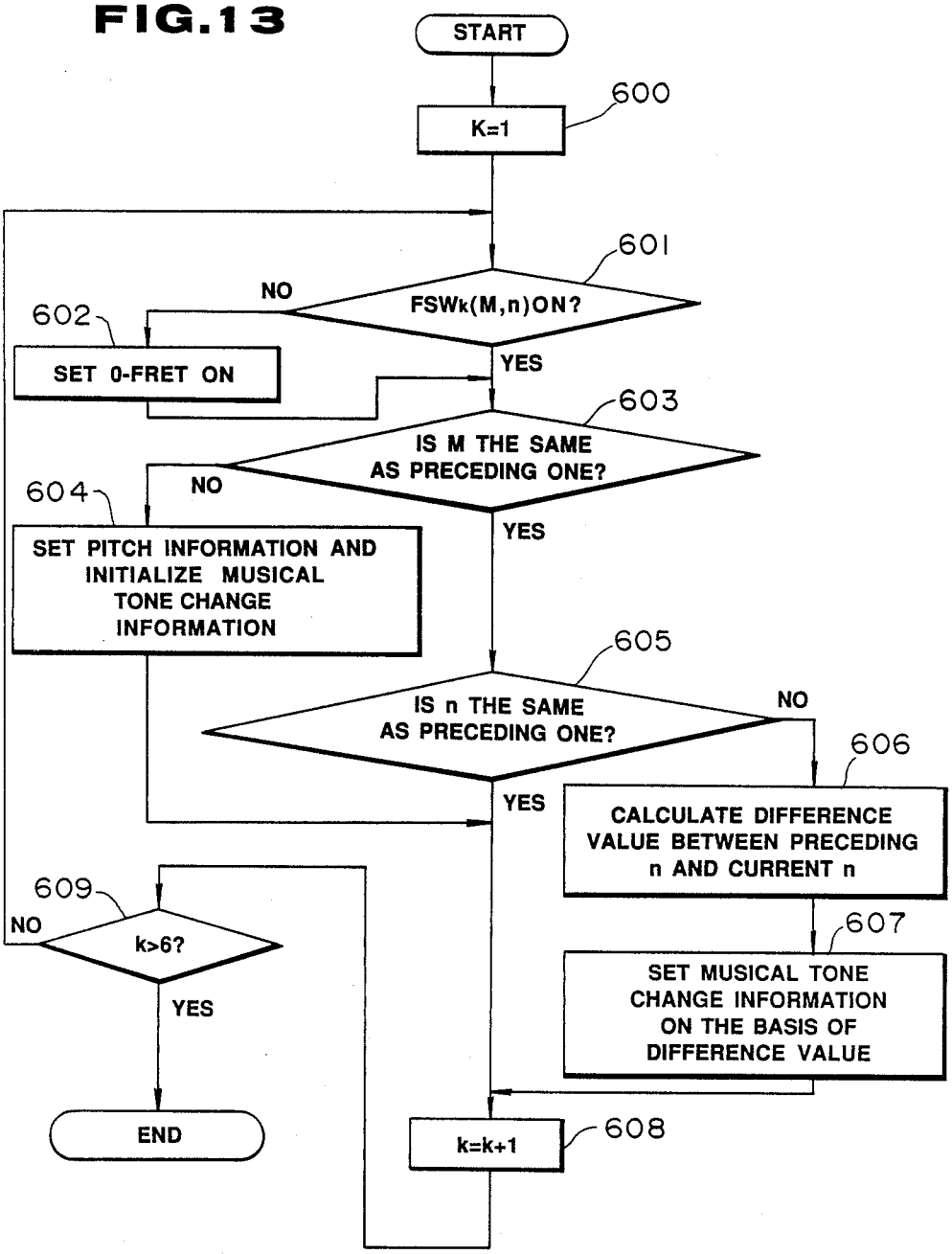
FIG. 13 is a flow chart for explaining processing tasks from fret state detection to musical tone change information setting of the electronic stringed instrument according to the fourth embodiment of the present invention.
Figure 14:
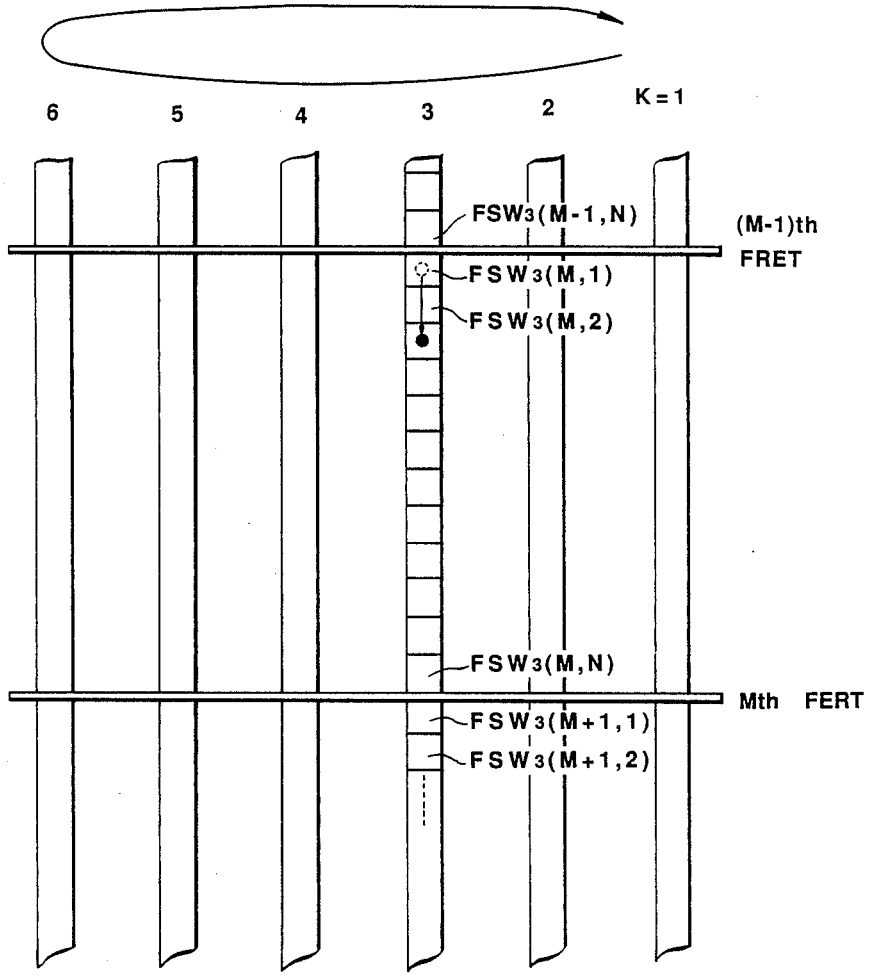
FIG. 14 is a view for explaining flow charts shown in FIGS. 13, 15 and 16.
Figure 15:
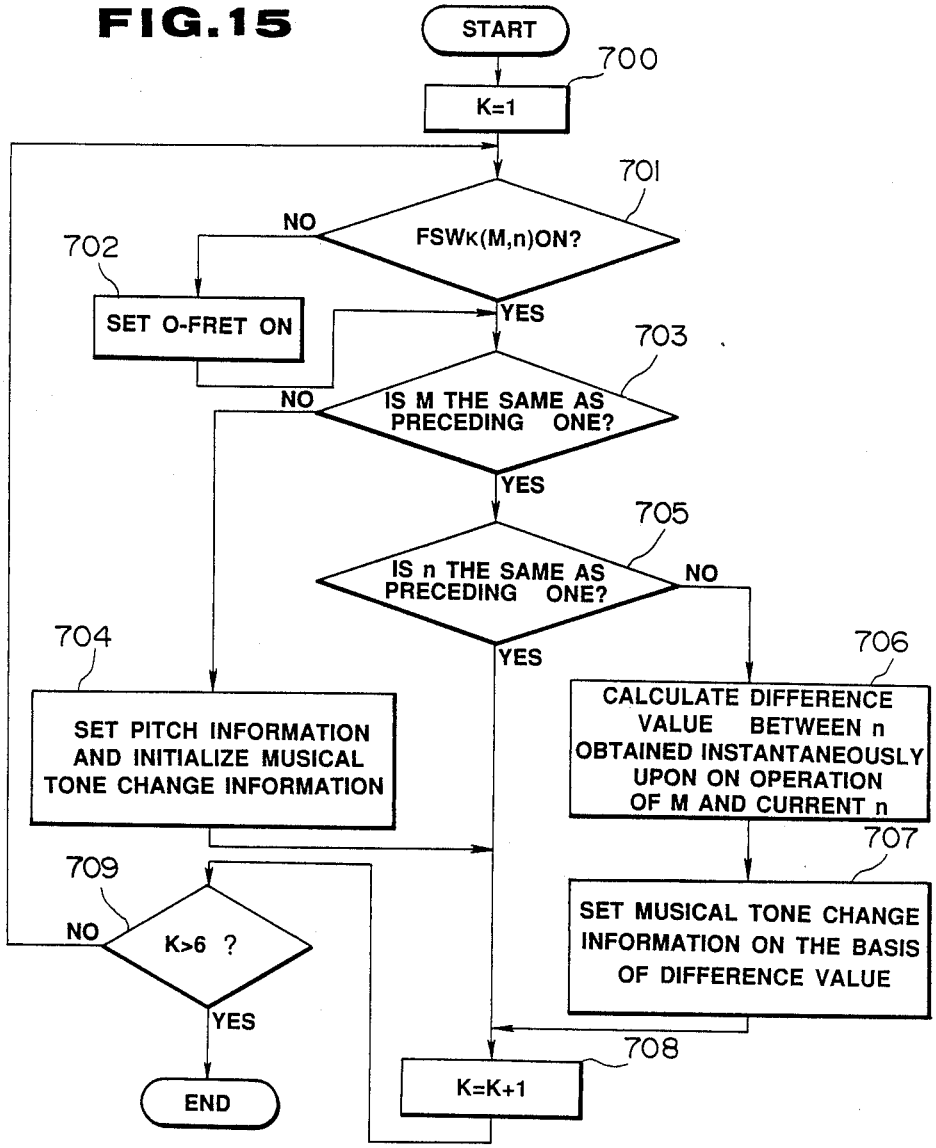
FIG. 15 is a flow chart for explaining processing tasks from fret state detection to musical tone change information setting of the electronic stringed instrument according to the fifth embodiment of the present invention.

FIG. 15 is a processing flow chart showing the feature of the fifth embodiment and corresponds to FIG. 13 of the fourth embodiment. FIG. 15 differs from FIG. 13 in only step 706.

That is, in step 606 shown in FIG. 13 of the fourth embodiment, a differential value between string depression position numbers of precedingly- and currently-ON fret operation position detection switches $FSW_3$ is calculated, and the value of a parameter of a musical tone to be generated is changed on the basis of the differential value. According to the fifth embodiment, however, in step 706 shown in FIG. 15, a differential value between a string depression position number of a fret operation position detection switch $FSW_3$ turned on in a fret switch FSW instantaneously upon ON operation of the fret switch FSW and a string depression position number of a currently-ON fret operation position detection switch FSW is calculated, and the value of a parameter of a musical tone to be generated is changed on the basis of the differential value.

Effects of the 5th Embodiment

According to the fifth embodiment, in an electronic stringed instrument, when a so-called vibrato performance in which a finger is finely moved in a string taut direction is performed, unique effects which cannot be obtained by a traditional stringed instrument can be added to a musical tone in accordance with a moving amount of the finger.

6th Embodiment

A sixth embodiment of the present invention will be described below.

The sixth embodiment is characterized in that when a single pitch unit (single fret position number) of a pitch designation area (corresponding to a single string) is depressed, the value of a parameter of a musical tone is changed, only when a depression position of the depression continuously changes in the single pitch unit and a musical tone corresponding to the depression is being generated, on the basis of a component of the change of the depression position in the longitudinal direction of a fingerboard.

The sixth embodiment differs from the above fourth embodiment in only its processing. Therefore, only a processing flow chart as a feature of the sixth embodiment will be described below.

Figure 16:
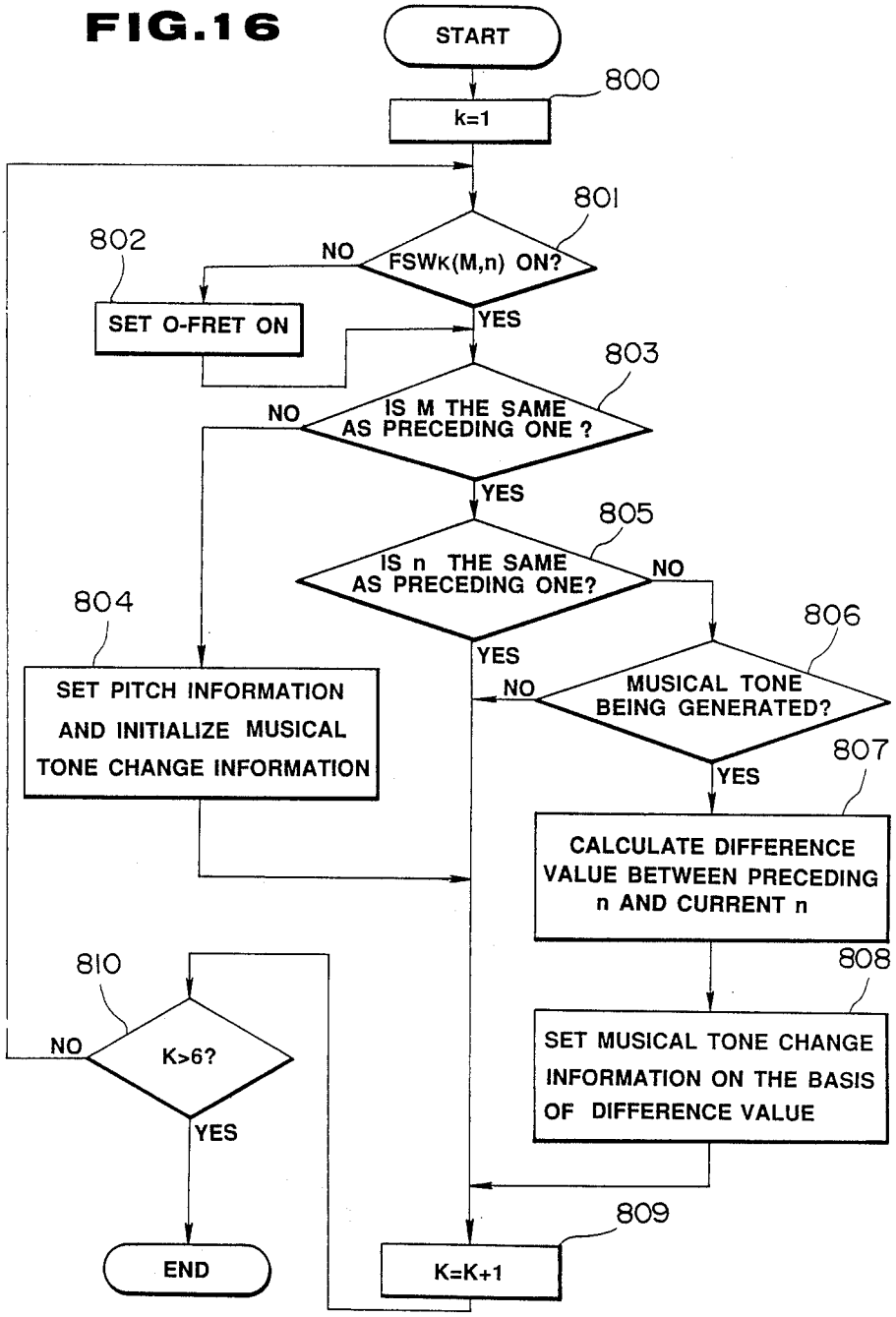
FIG. 16 is a flow chart for explaining fret state detection to musical tone change information setting of the electronic stringed instrument according to the sixth embodiment of the present invention.

FIG. 16 is a flow chart showing the feature of the sixth embodiment and corresponds to FIG. 13 of the fourth embodiment. FIG. 16 differs from FIG. 13 in only step 806.

That is, in step 606 of the fourth embodiment, regardless of whether a string corresponding to a fret switch FSW is generating a musical tone, a differential value between string depression position numbers of precedingly- and currently-ON fret operation position detection switches $FSW_3$ is calculated, and the value of a parameter of a musical tone to be generated is changed on the basis of the differential value. According to the sixth embodiment, however, in steps 806 and 807 shown in FIG. 16, whether a string corresponding to a fret switch FSW is generating a musical tone is checked. Only when it is determined that the string is generating a musical tone, a differential value between string depression position numbers of precedingly- and currently-ON fret operation position detection switches $FSW_3$ is calculated, and the value of a parameter of a musical tone to be generated is changed on the basis of the differential value.

Effects of the 6th Embodiment

According to the sixth embodiment, in an electronic stringed instrument, even when a so-called vibrato performance in which a finger is finely moved in a string taut direction is performed, the value of a parameter of a musical tone to be generated is not changed if a string for which the vibrato performance is executed is not generating a musical tone. Therefore, effects close to a traditional stringed instrument can be added to a musical tone.

In the above first to sixth embodiments, the strings 5 are extended on the fingerboard 9. The strings 5, however, need not be extended on the fingerboard 9 but may be extended on only the body 2. In addition, the number of strings is arbitrarily selected. In the above embodiments, a plurality of frets 10 are arranged on the fingerboard 9 at chromatic intervals as in a guitar in its longitudinal direction. The frets, however, need not be formed on the fingerboard 9. When the frets 10 are to be formed on the fingerboard 9, a fret interval need not be a chromatic interval but may be arbitrarily selected. Also, in the above embodiments, the fret switches FSW as fret state detecting means and the fret operation switch position switches $FSW_3$ . . . as fret operation position detecting means are formed not independently of each other in units of frets 10. An arrangement of these switches, however, is not limited to the above one. For example, the fret switch FSW may be located at a central position between the frets 10, and a plurality of fret operation position switches $FSW_3$ may be formed at both sides of the fret switch FSW. In the above embodiment, when a fret operation position is finely changed after a musical tone having a pitch designated by each fret switch FSW is generated in correspondence with an ON state of a string trigger switch TSW, the frequency of the musical tone currently being generated is changed in accordance with the change state. The musical tone, however, need not be changed after the string trigger switch TSW is turned on. For example, when the present invention is applied to an electronic stringed instrument of a type in which, even if the string trigger switch TSW is not turned on, if only a fret operation is performed, a musical tone having a pitch corresponding to the operated fret position is generated, the pitch of the musical tone being generated by the fret operation may be finely changed in accordance with a fine change of the fret operation position. In the above embodiments, the present invention is applied to an electronic stringed instrument of a type in which a musical tone having a pitch designated by a fret switch FSW is generated in correspondence with an ON state of string trigger switch TSW. The present invention, however, may be applied to electronic stringed instruments of various types in addition to an electronic stringed instrument using the fret switch FSW and the string trigger switch TSW. For example, the present invention can be applied to an electronic stringed instrument of an ultrasonic type (e.g., described in U.S. Pat. No. 4,723,468) in which an ultrasonic wave is propagated in a string, and a reflected time of the ultrasonic wave from a fret position in contact with the string is measured by a fret operation, thereby designating a pitch.

The first to sixth embodiments of the present invention and their various modifications have been described above. It is apparent, however, that the present invention can be variously modified and is not limited to the above embodiments and the like.

Figure 17:
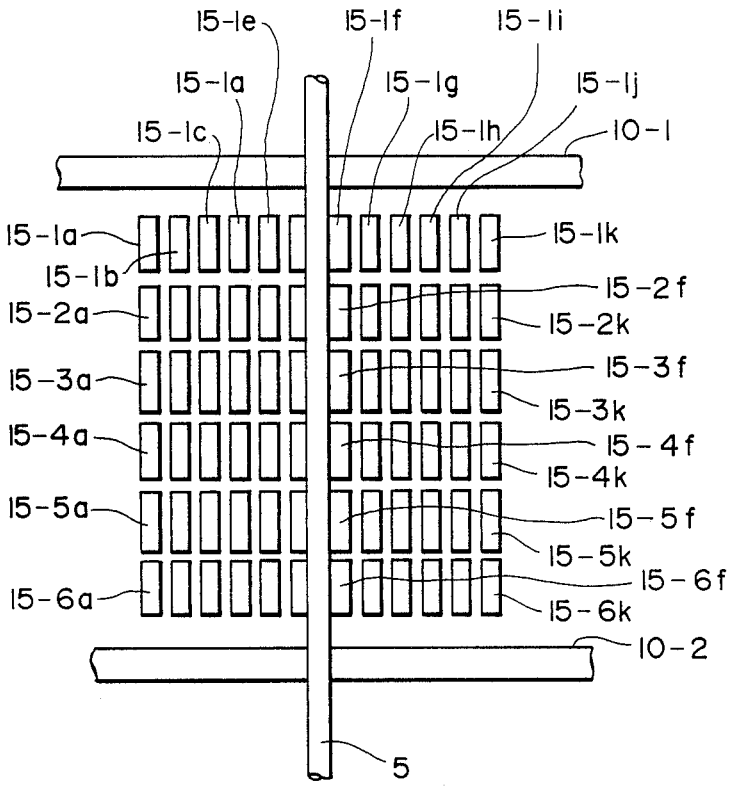
FIG. 17 is an enlarged plan view of a fret switch FSW used in a further embodiment of the invention.

FIG. 17 shows another fret-switch matrix according to the invention which has two kinds of fret switches, i.e. the fret switches shown in FIG. 3 and the fret switches shown in FIG. 11. As is shown in FIG. 17, six center contacts 15-1*f* to 15-6*f* are arranged between two frets 10-1 and 102 at regular intervals in the lengthwise direction of a string 5, i.e., in the column direction. Of these center contacts, the contact 15-*1f* is one of the 11 contacts 15-*la* to 15-1*k* arranged in a line extending at right angles to the string 5, that is, in the row direction. Similarly, a row of contacts 15-2*a* to 15-2*k*, a row of contacts 15-3*a* to 15-3*k*, . . . and a row of contacts 15-6*a* to 15-6*k* are located between the frets 10-1 and 10-2, whereby all these contacts 15 are arranged in rows and columns.

In the embodiment shown in FIG. 17, fixed contacts (not shown), which are equivalent to the fixed contacts 16 shown in FIG. 11, are located, opposing the movable contacts 15-*la* to 15-6*k* which form a matrix. A CPU (not shown, either), which is equivalent to the CPU 20, always scans the the state of connections among the fixed contacts and the movable contacts.

When the player presses, with a finger, that portion of the string 5*d* which extends between the frets 10-1 and 10-2, and moves his finger back and forth, while pressing the string 5, some or all of the contacts 15-1*f* to 15-6*f* are sequentially connected to the fixed contacts, whereby vibrato playing is performed. Simultaneously, the player can move said portion of the string 5 in the direction at right angles to the string 5, while keeping the string 5 pressed. Hence, the player can vary the color, volume, tremolo, etc. of the tone.

What is claimed is:

1. An electronic musical instrument comprising:

a fingerboard having pitch designation areas corresponding to strings, formed in a longitudinal direction thereof in a one-to-one correspondence;

first detecting means, including contacts formed in said pitch designation areas and corresponding to pitches, for detecting, when a position in said pitch designation areas is depressed, the depressed position in the longitudinal direction of said fingerboard;

second detecting means, including a plurality of contacts arranged in said pitch designation areas along a direction different from the longitudinal direction of said fingerboard, for detecting, when a position in said pitch designation areas is depressed, the depressed position in the direction different from the longitudinal direction of said fingerboard;

pitch determining means for determining a pitch of a musical tone to be generated on the basis of a detection result of said first detecting means; and parameter value changing means for changing a value of a parameter of the musical tone to be generated on the basis of a detection result of said second detecting means.

2. An electronic musical instrument according to claim 1, wherein said contacts of said first detecting means and said contacts of said second detecting means are common contacts which are commonly used.

3. An electronic musical instrument according to claim 2, wherein said common contacts commonly used as said first and second detecting means include a plurality of stationary contacts formed on a printed circuit board and a plurality of movable contacts formed on a flexible sheet on said printed circuit board at positions opposite to said plurality of stationary contacts.

4. An electronic musical instrument according to claim 3, wherein said movable contacts of said common contacts commonly used as said first and second detecting means are a plurality of movable contacts corresponding to said plurality of stationary contacts in a one-to-one relationship.

5. An electronic musical instrument according to claim 1, wherein the parameter whose value is changed by said parameter value changing means is a pitch parameter for controlling the pitch of the musical tone and further changing the pitch of the musical tone determined by said pitch determining means.

6. An electronic musical instrument according to claim 1, wherein the parameter whose value is changed by said parameter value changing means is a tremolo parameter for changing the pitch of the musical tone with respect to a time.

7. An electronic musical instrument according to claim 1, wherein the parameter whose value is changed by said parameter value changing means is a timbre parameter for controlling a timbre of a musical tone.

8. An electronic, musical instrument according to claim 1, wherein the parameter whose value is changed by said parameter value changing means is a volume parameter for controlling a volume of the musical tone.

9. An electronic musical instrument according to claim 1, wherein said second detecting means detects, when a position of said pitch designation areas is depressed, the depressed position in a direction perpendicular to the longitudinal direction of said fingerboard.

10. An electronic musical instrument according to claim 1, wherein said parameter value changing means changes the value of the parameter of the musical tone to be generated on the basis of a difference between a detection result output from said second detecting means upon depression of a reference position of said pitch designation area and a detection result output from said second detecting means during depression of said pitch designation area.

11. An electronic musical instrument according to claim 10, wherein the parameter whose value is changed by said parameter value changing means is a pitch parameter for controlling the pitch of the musical tone and further changing the pitch of the musical tone determined by said pitch determining means.

12. An electronic musical instrument according to claim 1, wherein when said pitch designation area is depressed, said parameter value changing means changes the value of the parameter of the musical tone to be generated on the basis of a difference between a detection result from said second detecting means obtained instantaneously upon depression and a detection result from said second detecting means during depression.

13. An electronic musical instrument according to claim 12, wherein the parameter whose value is changed by said parameter changing means is a pitch parameter for controlling the pitch of the musical tone and further changing the pitch of the musical tone determined by said pitch determining means.

14. An electronic musical instrument according to claim 1, wherein strings corresponding to said pitch designation areas are extended on said fingerboard in the longitudinal direction thereof.

15. An electronic musical instrument comprising:

a fingerboard having pitch designation areas corresponding to strings, formed in a longitudinal direction thereof, each of which is further divided into a plurality of pitch units in the longitudinal direction of said fingerboard;

first detecting means, including contacts formed in respective pitch units, for detecting, when a point of said pitch designation area is depressed, a pitch unit of said pitch designation area to which the depressed point belongs;

second detecting means, including a plurality of contacts arranged in said pitch unit along the longitudinal direction of said fingerboard, for detecting, when a position of said pitch designation area is depressed, the depressed position in said pitch unit along the longitudinal direction of said fingerboard;

pitch determining means for determining a pitch of a musical tone to be generated on the basis of a detection result from said first detecting means; and parameter value changing means for changing, when said pitch designation area is depressed, a value of a parameter of the musical tone to be generated, only when a depression position changes in a single pitch unit, on the basis of a component of the change in the longitudinal direction of said fingerboard obtained in accordance with a detection result from said second detecting means.

16. An electronic musical instrument according to claim 15, wherein said pitch designation area is divided in pitch of chromatic intervals in the longitudinal direction of said fingerboard.

17. An electronic musical instrument according to claim 15, wherein said contacts of said first detecting means and said contacts constituting said second detecting means are common contacts which are commonly used.

18. An electronic musical instrument according to claim 18, wherein said common contacts commonly used as said first and second detecting means include a plurality of stationary contacts formed on a printed circuit board and a plurality of movable contacts formed on a flexible sheet on said printed circuit board at positions opposite to said plurality of stationary contacts.

19. An electronic musical instrument according to claim 19, wherein said movable contacts of said common contacts commonly used as said first and second detecting means are a plurality of movable contacts corresponding to said plurality of stationary contacts in a one-to-one relationship.

20. An electronic musical instrument according to claim 15, wherein the parameter whose value is changed by said parameter value changing means, is a pitch parameter for controlling the pitch of the musical tone and further changing the pitch of the musical tone determined by said pitch determining means.

21. An electronic musical instrument according to claim 15, wherein the parameter whose value is changed by said parameter value changing means is a tremolo parameter for changing the pitch of the musical tone with respect to a time.

22. An electronic musical instrument according to claim 15, wherein the parameter whose value is changed by said parameter value changing means is a timbre parameter for controlling a timbre of the musical tone.

23. An electronic musical instrument according to claim 15, wherein the parameter whose value is changed by said parameter value changing means is a volume parameter for controlling a volume of the musical tone.

24. An electronic musical instrument according to claim 15, wherein only when a depression position of said pitch designation area continuously changes in a single pitch unit after a musical tone is generated, said parameter value changing means changes the value of the parameter of the musical tone being generated on the basis of a component of the change in the longitudinal direction of said fingerboard obtained in accordance with a detection result from said second detecting means.

25. An electronic musical instrument according to claim 25, wherein a parameter whose value is changed by said parameter value changing means is a pitch parameter for controlling the pitch of the musical tone and changing the pitch of the musical tone being generated.

26. An electronic musical instrument according to claim 15, wherein strings corresponding to said pitch designation areas are extended on said fingerboard along the longitudinal direction thereof.

27. An electronic musical instrument comprising:

a fingerboard in which pitch designation areas corresponding to strings are formed in the longitudinal direction of said fingerboard in a one-to-one correspondence with respect to said strings;

output means, including a plurality of contacts corresponding to said strings and arranged in said pitch designation area in a matrix manner along a longitudinal direction of said strings and a direction intersecting with the longitudinal direction of the strings, for outputting a detection output concerning a depression position on said pitch designation area;

determining means for determining a pitch of a musical tone and a tone parameter value other than the pitch of the musical tone in accordance with the detection output; and generating means for generating a musical tone in accordance with an output from said determining means

* * * * *